US005828757A

United States Patent [19]

Michalsen et al.

[11] Patent Number: 5,828,757

[45] Date of Patent: Oct. 27, 1998

[54] DIRECTIONAL HEARING AID ASSEMBLY

[76] Inventors: Robert M. Michalsen, 1434 Oakwood Ave., Des Plaines, Ill. 60016; Beatrix Kopesdy, 3 Saville Row, Barrington Hills, Ill. 60010

[21] Appl. No.: 766,188

[22] Filed: Dec. 12, 1996

[51] Int. Cl.[6] ..... H04R 25/00

[52] U.S. Cl. ..... 381/68.6; 381/69; 63/12; 63/13; 63/14.8

[58] Field of Search ..... 381/68.6, 69, 187, 381/183; 63/12–14.8; 181/135, 130

[56] References Cited

U.S. PATENT DOCUMENTS 1,852,130 4/1932 Schier ..... 63/14.4
1,953,437 4/1934 Schier ..... 63/14.4
2,506,116 5/1950 Strarkey ..... 63/14.4
2,521,414 9/1950 Schier ..... 63/14.4

*Primary Examiner*—Curtis A. Kuntz
*Assistant Examiner*—Rexford Barnie
*Attorney, Agent, or Firm*—Meroni & Meroni

[57] ABSTRACT

A hearing aid assembly is provided. The assembly includes a housing sized and configured for insertion within an ear canal of a user. Electronics are disposed within the housing for amplifying sound. A sound receiving structure is provided for operatively transferring sound waves to the electronics. The sound receiving structure has a first end operatively connected with the electronics and a second end extending outwardly from the housing at a position horizontally forward of the ear canal for receiving sound waves emanating from a position generally forward of the user.

9 Claims, 4 Drawing Sheets

DIRECTIONAL HEARING AID ASSEMBLY

BACKGROUND OF THE INVENTION

1. Field of the Invention

The present invention relates generally to hearing aids. More particularly, the invention pertains to a concealed hearing aid assembly having improved sound reception from a direction forward of a user.

2. Description of the Prior Art

While millions of individuals suffer from some amount of hearing loss, only a smaller percentage of these individuals seek the use of some type of hearing aid to improve their hearing. This is largely due to the generally unattractive nature of the hearing aid and the undesired attention it receives from others.

Various prior art devices have been proposed to decorate or otherwise attempt to conceal the hearing aid when attached to a user. U.S. Pat. No. 2,595,672 issued to Greenwood discloses an ornamental cover for a hearing aid which is inserted into the ear of a user. The ornamental cover includes a clamp that is detachably supported on the hearing aid to allow the user to substitute covers for those that differ in color and in ornamental design.

Advancements in electronic technology over the years have allowed for the miniaturization of the parts used in hearing aids. U.S. Pat. No. 5,365,593 issued to Greenwood et al. discloses a hearing aid sized for engagement within a user's ear. An outer surface of the hearing aid has an ornamental attachment secured thereto to conceal the hearing aid and allow for operative control of the volume of the hearing aid.

While such devices provide a manner of concealment of the hearing aid, they suffer in a number of regards. For example, the placement of ornamentation about the central portion of a user's ear as disclosed in some of these devices is not a common practice. Earrings, for example, are secured on the earlobe of an ear leaving the central portion of the ear remaining generally exposed. Hence, while the hearing aid itself may be concealed, the location of the ornamentation remains different than that known in the usage of earrings.

In recent years, completely-in-the-canal (CIC) hearing aids have provided yet another option for hearing impaired users. Due to the latest advancements in the miniaturization of hearing aid components, the CIC hearing aid in its entirety is inserted well within the ear canal to provide cosmetic acceptability without the need for any additional decorative members, such as described above in Greenwood et. al.

It has been theorized that the placement of the microphone of the CIC hearing aid inside the ear canal allows the convolutions of the concha to remain open to provide the spectral filtering that assists in directional hearing abilities. However, through testing we have found that the CIC hearing aid fails to provide for adequate hearing ability of sounds emanating in front of a user in comparison to sounds emanating from behind a user.

As will be described in greater detail hereinafter, the assembly of the present invention solves the aforementioned problem and employs a number of novel features that render it highly advantageous over the prior art.

SUMMARY OF THE INVENTION

Accordingly, it is an object of this invention to provide a hearing aid adapted for concealed operation of the hearing aid on a user.

Another object of this invention is to provide a hearing aid assembly that provides improved reception of sounds that emanate from in front of a user and beneficial attenuation of sound from the rear direction.

Still another object of this invention is to provide a hearing aid assembly which is comfortable to wear and is able to utilize much of the technology of present day CIC hearing aids, while at the same time offer improved sound reception.

Yet another object of this invention is to provide a hearing aid that can be used in combination with an earring to provide concealment of a microphone located remote from the rest of the hearing aid. The earring having a removable or replaceable decorative member to allow a user to selectively exchange the decorative member for proper fashion coordination with the user's clothing.

To achieve the foregoing and other objectives, and in accordance with the purposes of the present invention a hearing aid assembly is provided. The assembly includes a housing sized and configured for insertion within an ear canal of a user. Electronic means are disposed within the housing for amplifying sound. The electronic means include a receiver, circuitry, and battery electronically connected with one another. A sound receiving structure is provided for operatively transferring sound waves to the electronic means. The sound receiving structure has a first end operatively connected with the electronic means and a second end extending outwardly from the housing at a position horizontally forward of the ear canal for receiving sound waves emanating from a position generally forward of the user.

In accordance with an aspect of the invention, the sound receiving structure includes a microphone electrically connected with the electronic means and disposed within the housing. A tube structure is provided having an air passageway extending therethrough. The tube structure has first and second ends. The first end is operatively connected to the microphone and the second end extends outwardly from the housing and immediately adjacent to an outer edge of a tragas portion of the user's ear.

In accordance with another aspect of the invention, the sound receiving structure includes a thin elongated wire structure having first and second wire ends. The first wire end extends within the housing for electrically connecting with the electronic means. The second wire end extends outwardly from the housing at a position forward of the ear canal. A microphone is electrically connected to the second wire end for use in combination with an earring structure to provide concealment of the microphone.

Other objects, features and advantages of the invention will become more readily apparent upon reference to the following description when taken in conjunction with the accompanying drawings, which drawings illustrate several embodiments of the invention.

DETAILED DESCRIPTION OF THE PREFERRED EMBODIMENT

Figure 1:
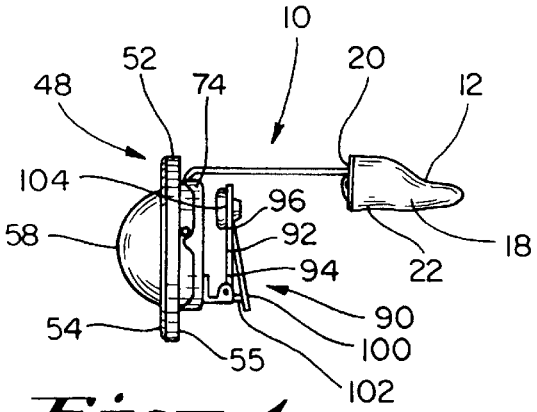
FIG. 1 is a perspective view of the present invention.

Referring now to the drawings, a first embodiment of a directional hearing aid assembly is illustrated in FIGS. 1–5 and is indicted by the numeral 10.

Figure 3:
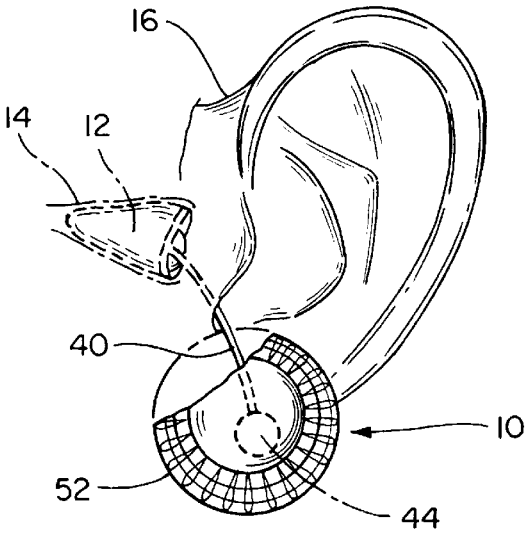
FIG. 3 is a partially sectional front view of the present invention secured to an earlobe of a user.

The assembly 10 includes a hearing instrument 12 adapted for insertion within an ear canal 14 of a user 16 in a similar manner to conventional CIC hearing aids. The hearing instrument 12 includes a hearing aid housing 18 formed of plastic which is sized and configured for insertion the ear canal 14 (FIG. 3). A face plate 20 of the housing 18 is disposed on an outermost end 22 of the housing 18. The housing 18 is preferably formed in a customized manner to fit a particular user's ear canal 14 shape.

Figure 5:
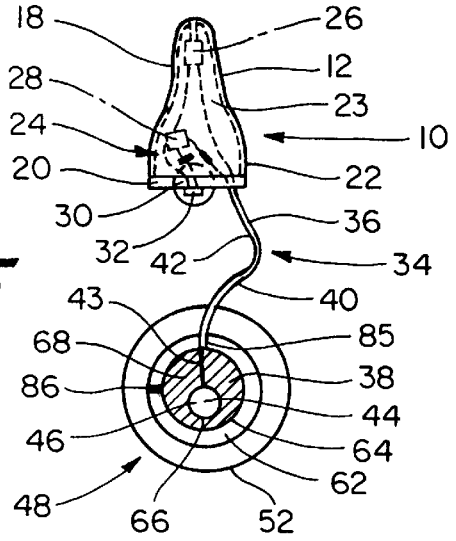
FIG. 5 is a side view of the decorative member showing the microphone inserted within the interior chamber.

Referring to FIG. 5, the housing 18 defines an interior portion 23 that contains the necessary electronics 24 for amplifying sound. The electronics 24 includes a receiver 26, circuitry 28, and a battery 30 electronically connected with one another. A volume control component 32 may also be provided. The aforementioned electronic components are known in the art for use in CIC hearing aids and further description is therefore not believed necessary.

A sound receiving means or structure 34 is provided for operatively transferring sound waves to the electronics 24 in the housing 18. The sound receiving means 34 in all of the disclosed embodiments has a first end 36 operatively connected with the electronic means 24 and a second end 38 extending outwardly from the housing 18 at a position horizontally forward of the ear canal 14 for receiving sound waves emanating from a position generally forward of the user.

It should be understood that while the sound receiving structure 34 is configured for receiving sound waves emanating from a position generally forward of the user 16, this is not to say that sounds to the sides and rear are not still received. However, while sounds from the front and sides are received quite effectively with the present invention, there is a beneficial sound attenuation from the rear, which is an important improvement in the directionality of the present invention over prior art devices.

In the first embodiment of the assembly 10, the sound receiving structure 34 includes a thin flexible elongated wire structure 40 having first and second wire ends 42,43. Preferably, the wire structure 40 is of this embodiment is a three strand copper wire. The first wire end 42 extends within the housing 18 for electrically connecting with the electronics 24. The second wire end 43 extends outwardly from the housing 18 at a position forward of the ear canal 14. A microphone 44 secured to a plastic base 46 is electrically connected to the second wire end 43.

Figure 4:
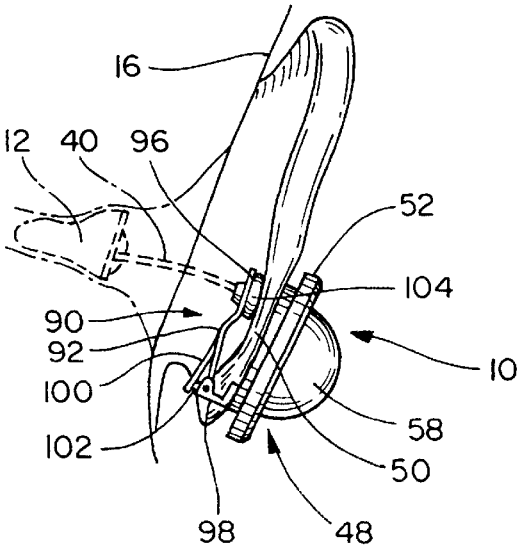
FIG. 4 is a perspective side view of the present invention secured to the earlobe of the user.

The hearing instrument 12 of assembly 10 is used in combination with an earring assembly 48. The earring assembly 48 attaches to an earlobe 50 of the wearer or user 16, as shown in FIGS. 3 and 4, in a manner similar to conventional clip-on type earrings.

Figure 2:
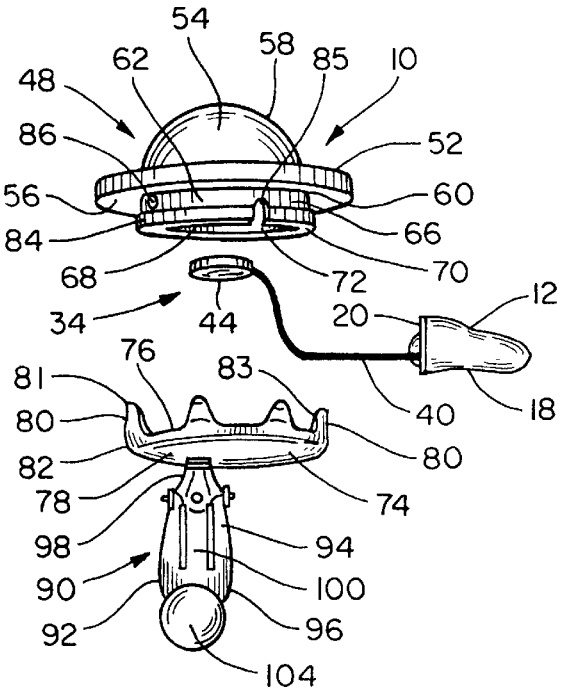
FIG. 2 is an exploded perspective view of the present invention.

Referring to FIG. 2, the assembly 48 includes a decorative member 52 having a front side 54 and a back side 56. The front side 54 has an ornamental outer surface 58. The back side 56 of the decorative member 52 has an aperture 60 coaxial with a longitudinal axis of the decorative member 52. The aperture 60 is sized for receiving a portion of a housing 62 therewithin. The housing 62 has a bottom portion 64 (FIG. 5) and an annular sidewall 66 defining an interior chamber 68. The sidewall 66 has a chamber edge 70 defining an opening 72 of the interior chamber 68. While the bottom portion 64 of the housing 62 is connected within the aperture 60 of the decorative member 52, it should also be understood that the decorative member 52 and housing 62 could be formed integral together as a one piece member.

Referring to FIGS. 1 and 2, a backing member 74 has a first side 76 and a second side 78. The backing member 74 has a plurality of spaced apart flexible fingers 80 projecting rearwardly from the first side 76 of the backing member 74 along a peripheral annular edge 82 in a spaced apart relationship to one another and preferably arranged in a continuous annular row. The fingers 80 are removably and rotatably connected with the chamber edge 70 in a snap-on type engagement. The chamber edge 70 has an outwardly extending flange 84. Each finger 80 has an outwardly bent portion 81 and an inwardly bent portion 83. The bent portions 81,83 of each finger 80 extend about the flange 84 to both retain the backing member 74 to the chamber edge 70 and allow the chamber edge 70 to rotate. The backing member 74 when connected to the chamber edge 70 substantially encloses the opening 72 of the interior chamber 68.

Referring to FIG. 2, the earring housing 62 has first and second apertures or slots 85,86 in communication with the interior chamber 68. The first aperture 85 faces generally upwardly for extension of the wire structure 40 therethrough. The microphone 44 is housed within the interior chamber 68. The second aperture 86 faces generally parallel to a user's front side for receiving sound waves therewithin emanating from a direction generally forward of the user. As best illustrated in FIG. 5, the first and second apertures 85,86 are preferably at 90° to one another. While additional holes into the interior chamber 68 could be provided to allow sound to be absorbed within for reception by the microphone 44, it has been found that the forward horizontally facing second aperture 86 performs especially well and significantly reduces sound emanating from behind the user 16 to aid in directionality.

A clamping structure 90 is attached to the second side 78 of the backing member 74 for removably clamping the assembly 48 to the earlobe 12 of the wearer 16 with the ornamental outer surface 58 of the decorative member 52 facing away from the earlobe 50, as best illustrated in FIG. 2.

The clamping structure 90 includes a clamping arm 92 having opposite first and second ends 94,96 and a bracket 98 pivotally connected with the first end 94 so that the second end 96 is pivotable toward and away from the backing member 74. A resilient member 100 of the clamping arm 92 extends coplanar with the clamping arm in a open position shown in FIG. 2. When the clamping arm 92 is pivoted in a closed position, as shown in FIG. 4, an upright member 102 of the bracket 98 biases the resilient member 100 outwardly to produce tension in the clamping structure 90 to hold the clamping structure 90 in the closed position in secured engagement with the earlobe 50. The second end 96 may also have a flexible pad 104 attached thereto to provide additional comfort for the wearer 16.

Figure 6:
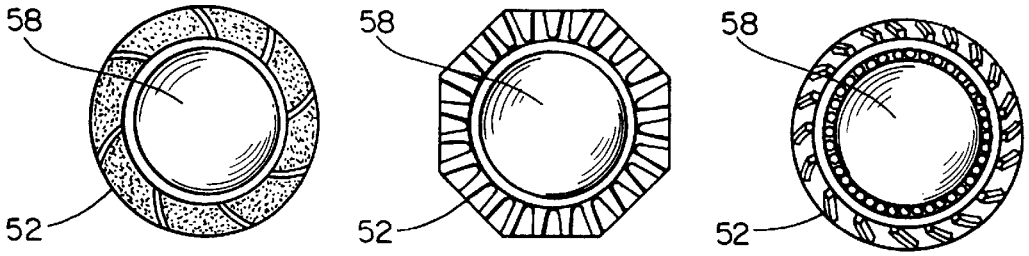
FIG. 6 is a top view of alternative decorative members for use with the present invention shown in FIGS. 1–4.
Figure 7:
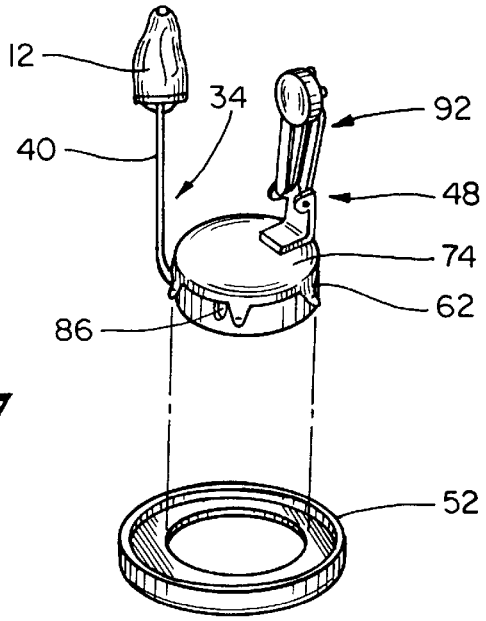
FIG. 7 is a partially exploded perspective view of an alternative embodiment of the present invention.

In use, a wearer 16 may interchange the removable decorative member 52 with other decorative members 52 (FIG. 6) having different ornamental outer surfaces 58 or colors to allow a wearer 16 to selectively exchange the decorative member 52 for proper fashion coordination with the wearer's clothing. To this degree, exchanging the decorative member 52 in the first embodiment of FIG. 2 requires a wearer to disassemble the entire assembly 48 for reassembly with a different decorative member 52. In an alternative embodiment of the earring assembly 48 shown in FIG. 7, the housing 62 is not fixedly connected to or formed integral with the decorative member 52 and instead is removably engageable with the decorative member 52. Hence, the housing 62 with the microphone 44 inside, the backing member 74, sound receiving structure 34, and hearing instrument 12 may be retained in assembly together when the decorative member 52 is exchanged.

Figure 11:
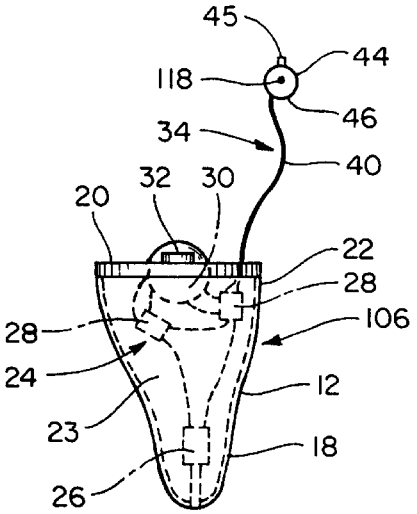
FIG. 11 is side view of the hearing aid assembly for use in another alternative embodiment.
Figure 12:
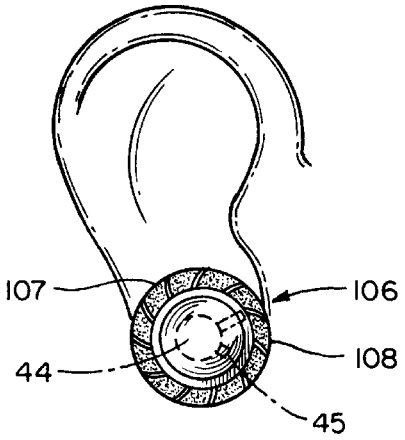
FIG. 12 is a side view of an earlobe having an earring structure connected with the hearing aid assembly of FIG. 11.
Figure 13:
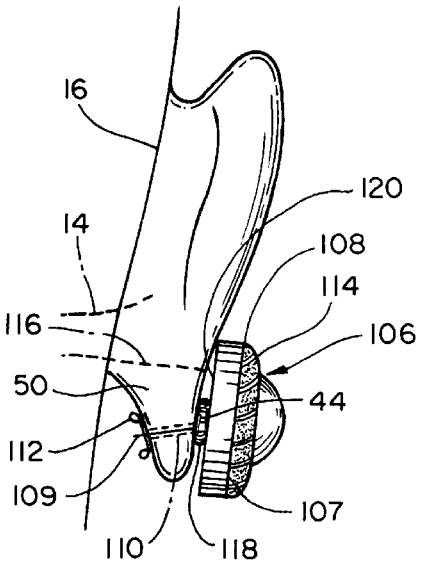
FIG. 13 is an end view of an earlobe having an earring structure connected with the hearing aid assembly of FIG. 11.

Referring to FIGS. 11–13, a second embodiment of a combination earring and hearing aid assembly is indicted by the numeral 106. Assembly 106 utilizes a hearing instrument 12 and a sound receiving structure 34 as previously described. However, unlike the first embodiment, assembly 106 is adapted for use with an earring structure 108 of conventional type having a decorative portion 107, a post 109 extendible through a pierced opening or hole 110 in the user's earlobe 50, and a backing member 112 removably attached to the post 109 to secure the earring structure to the earlobe 50.

Preferably, the decorative portion 107 is circular and has a diameter of sufficient length so that an outer edge 114 of the decorative portion 107 extends above the bottom surface 116 of the ear canal 14 to conceal the sound receiving structure 34 (FIG. 13). An aperture 118 (FIG. 11) is provided through the base 46 or portion of the microphone 44. The aperture 118 is sized for extending the post 109 therethrough to removably secure the microphone 44 to the post 109 for engagement between the earlobe 50 of the user 16 and a back side 120 of the decorative portion 107. A sound receiving port 45 of the microphone 44 is positioned in a forward direction of the user 16, as illustrated in FIG. 12.

Figure 8:
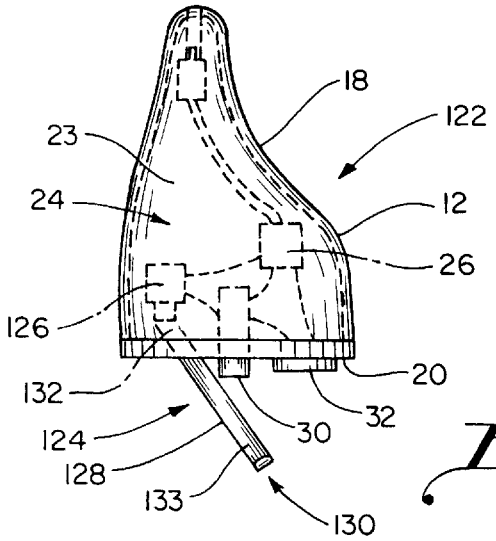
FIG. 8 is a side view of the hearing aid assembly of an alternative embodiment.
Figure 9:
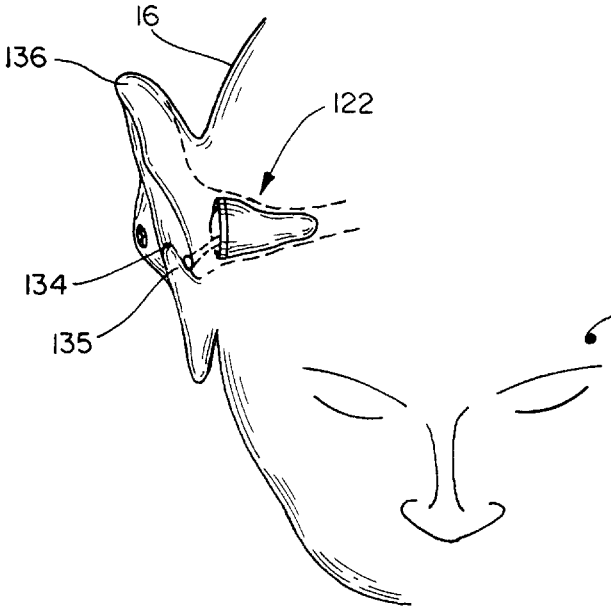
FIG. 9 is a diagrammatic front view of the position of the hearing aid assembly of FIG. 8 in a user.
Figure 10:
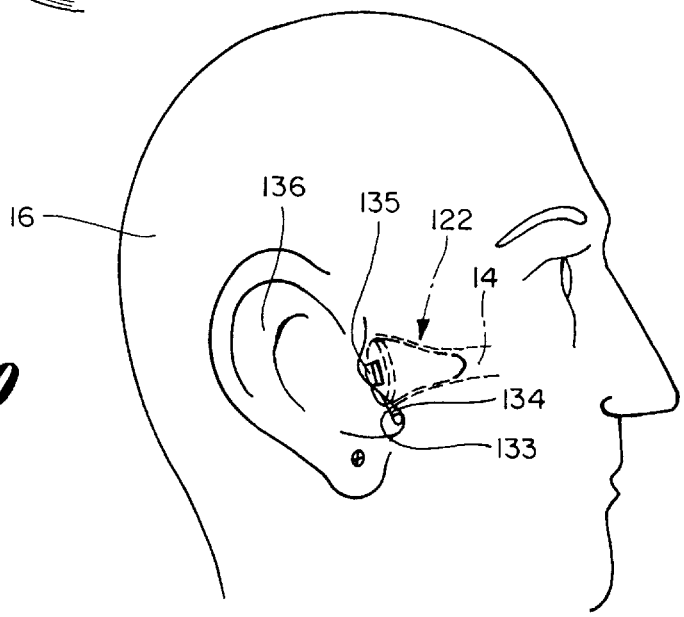
FIG. 10 is a diagrammatic side view of the position of the hearing aid assembly of FIG. 8 in a user.

Referring to FIGS. 8–10, a third embodiment of the hearing aid assembly is indicated by the numeral 122. The assembly 122 utilizes a hearing instrument 12 similar to that previously described, however in this embodiment the sound receiving structure 124 includes a microphone 126 electrically connected with the electronics 24 and disposed within the housing 18. The placement of a microphone within a CIC type hearing aid is well known in the art. However, because such a hearing aid is inserted into the ear canal, it has been found that it fails to provide for adequate hearing ability of sounds emanating in front of a user in comparison to sounds emanating from behind a user. In the present invention, such a problem has been eliminated.

In assembly 122, a tube structure 128 is provided having an air passageway 130 extending therethrough. The tube structure 128 has first and second ends 132,133. The first end 132 is operatively connected to the microphone 126 by engaging a hole in the face plate 20 in extending immediately adjacent with the microphone 126. The second end 133 of the tube structure 128 extends outwardly from the housing and immediately adjacent to an outer edge 134 of a tragas portion 135 of the user's ear 136.

In a preferred embodiment, the tube structure 128 is formed is a flexible plastic tube having a diameter less than 0.25 inches and is in an angled relationship generally in the range of 35° to 50° and/or to suit a user's ear canal 14 shape with the face plate 20 of the housing 18, as best illustrated in FIG. 8. Further, the first end 132 of the tube structure is preferably fixedly secured with the microphone 126 and the housing 18 with adhesive or other means so that a user may grasp and pull on the tube structure 128 to remove the hearing aid assembly 122 from within the ear canal.

Figure 14:
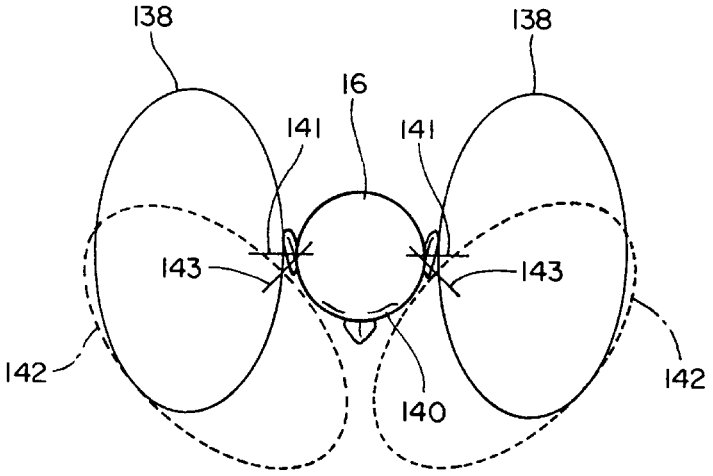
FIG. 14 is a diagrammatic plan view generally illustrating the improved range of sound received from the embodiments the present invention.

Referring to FIG. 14, a diagrammatic plan view generally illustrating the improved range of sound received from the embodiments the present invention is provided. With a prior art type of CIC hearing aid, a user's 16 strongest sound reception is generally in the range or emanating from or through the regions indicated by the numerals 138. It should be noted that the longitudinal axis 141 of the user's 16 ear canal 14 extend outwardly at direction generally rearwardly of the user's front side 140. The forward positioning of the sound receiving means in the present invention, at for example an axis 143 created by the assembly 122, allows for improved sound reception generally in the range or emanating from or through the regions indicated by the numerals 142. Hence, sounds forward and to the sides of the user are received at and amplified for the user 16 at a sufficient decibel range, whereas sounds to the rear of the user are beneficially attenuated.

Although the invention has been described by reference to some embodiments it is not intended that the novel device be limited thereby, but that modifications thereof are intended to be included as falling within the broad scope and spirit of the foregoing disclosure, the following claims and the appended drawings.

We claim:

1. A decorative earring and hearing aid assembly which is attachable to an earlobe of a wearer, the assembly comprising:

(a) a decorative member having front and back sides, the front side having an ornamental outer surface;

(b) an earring housing having a bottom portion and a sidewall defining an interior chamber, the sidewall having a chamber edge defining an opening of the interior chamber, the earring housing being connectable with the back side of the decorative member;

(c) a backing member having first and second sides, the backing member being removably connected to the housing to substantially enclose the opening of the interior chamber;

(d) clamping means attached to the second side of the backing member for removably clamping the assembly to the earlobe of the wearer with the ornamental outer surface of the decorative member facing away from the earlobe;

(e) a hearing aid housing sized and configured for insertion within an ear canal of a user;

(f) electronic means disposed within the hearing aid housing for amplifying sound, the electronic means including a receiver and circuitry electronically connected with one another; and (g) sound receiving means for operatively transferring sound waves to the electronic means, the sound receiving means including a thin elongated wire structure having first and second wire ends, the first wire end extending within the hearing aid housing and into the ear canal for electrically connecting with the electronic means, the second wire end extending outwardly from the hearing aid housing at a position forward of the ear canal in close proximity to a lowermost portion of the ear canal, the ear canal having an opening remaining substantially free of encumbrance, and a microphone electrically connected to the second wire end and disposed within the interior chamber.

2. The decorative earring and hearing aid assembly of claim 1, wherein the earring housing has first and second apertures in communication with the interior chamber, the first aperture facing generally upwardly for extension of the wire structure therethrough and a second aperture facing generally parallel to a user's front side for receiving sound waves therewithin emanating from a direction forward of the user.

3. The decorative earring and hearing aid assembly of claim 2, wherein the backing member has a plurality of spaced apart fingers projecting rearwardly from the first side of the backing member along a peripheral edge of the backing member, the earring housing having a chamber edge extending outwardly around a perimeter of the interior chamber, the fingers being removably connected with the chamber edge.

4. The decorative earring and hearing aid assembly of claim 1, wherein the back side of the decorative member has an aperture coaxial with a longitudinal axis of the decorative member, the aperture being sized for receiving the bottom portion of the earring housing therewithin.

5. The decorative earring and hearing aid assembly of claim 4, wherein the bottom portion of the housing is fixedly secured within the aperture.

6. The decorative earring and hearing aid assembly of claim 4, wherein the bottom portion of the housing is in removable engagement within the aperture.

7. A hearing aid assembly comprising:

(a) a housing sized and configured for insertion within an ear canal of a user;

(b) electronic means disposed within the housing for amplifying sound, the electronic means including a receiver and circuitry electronically connected with one another; and (c) sound receiving means for operatively transferring sound waves to the electronic means, the sound receiving means including a thin elongated wire structure having first and second wire ends, the first wire end extending within the hearing aid housing and into the ear canal for electrically connecting with the electronic means, the second wire end extending outwardly from the hearing aid housing at a position forward of the ear canal in close proximity to a lowermost portion of the ear canal, the ear canal having an opening remaining substantially free of encumbrance, and a microphone electrically connected to the second wire end; and (d) connecting means for removably securing the microphone to a post of an earring structure for engagement between an earlobe of the user and a back side of a decorative portion of the earring structure.

8. The hearing aid assembly of claim 7, wherein the connecting means includes an aperture extending through a portion of the microphone, the aperture being sized for extending the post therethrough.

9. A hearing aid assembly comprising:

(a) a housing sized and configured for insertion within an ear canal of a user;

(b) electronic means disposed within the housing for amplifying sound, the electronic means including a receiver and circuitry electronically connected with one another;

(c) sound receiving means for operatively transferring sound waves to the electronic means, the sound receiving means includes a thin elongated electrical wire structure having first and second wire ends, the first wire end extending within the housing for electrically connecting with the electronic means, the second wire end extending outwardly from the ear canal in close proximity to a lowermost portion of the ear canal, the ear canal having an opening remaining substantially free of encumbrance, and a microphone electrically connected to the second wire end; and (d) an earring assembly, the earring assembly including: a decorative member having front and back sides and an interior chamber, the microphone being in removable engagement within the interior chamber; a backing member having first and second sides, the backing member being removably attached to the decorative member with the first side of the backing member adjacent to the back side of the decorative member; and clamping means attached to the second side of the backing member for removably clamping the assembly to an earlobe of a user, the assembly being positioned substantially below the ear canal.

* * * * *